US005381732A

United States Patent [19]

Trout

[11] Patent Number: 5,381,732

[45] Date of Patent: Jan. 17, 1995

[54] CAN CRUSHER WITH METAL-PLASTIC SEPARATION CAPABILITY

[76] Inventor: Robert E. Trout, 2310 Walden Pl., Plant City, Fla. 33566

[21] Appl. No.: 72,906

[22] Filed: Jul. 14, 1993

[51] Int. Cl.[6] ..... B30B 15/30; B30B 9/32

[52] U.S. Cl. ..... 100/49; 100/91; 100/215; 100/218; 100/902

[58] Field of Search ..... 100/45, 49, 50, 91, 100/215, 218, 245, 902

[56] References Cited

U.S. PATENT DOCUMENTS

| | | | |
|---|---|---|---|
| 2,920,554 | 1/1960 | Burke | 100/902 X |
| 3,907,087 | 9/1975 | Tanaka | 100/49 X |
| 4,248,389 | 2/1981 | Thompson et al. | 100/91 X |
| 4,474,108 | 10/1984 | Lonze | 100/45 |
| 4,483,248 | 11/1984 | Ostreng | 100/91 X |
| 4,526,097 | 7/1985 | Cound | 100/902 X |
| 4,599,941 | 7/1986 | Johnson et al. | 100/902 X |
| 4,919,274 | 4/1990 | Hammond | 100/902 X |

*Primary Examiner*—Stephen F. Gerrity

[57] ABSTRACT

A can crusher, being motorized, and self contained, and having distinguishing capability between glass, plastic, and metal cans, or bottles, and having storage capability in the bottom of the cabinet which houses the can crushing apparatus.

3 Claims, 2 Drawing Sheets

CAN CRUSHER WITH METAL-PLASTIC SEPARATION CAPABILITY

BACKGROUND OF THE INVENTION

This invention relates to an apparatus and method of crushing, and thereby reducing the size, of aluminum soft drink cans, for shipping purposes, and, for distinguishing between the aluminum soft drink cans and the glass, or plastic bottles, used for the same purpose.

It has been customary in the soft drink industry, to use aluminum cans for packaging the product, ship these cans in packages of several different sizes to the customers, and, when the contents of the cans acre used, to have them collected, and recycle the aluminum into other products. In some cases, glass, or plastic containers are used instead of aluminum for this purpose. The use of glass, or plastic containers causes problems to the recycling industry, as there is no easy method of distinguishing between the plastic, and aluminum, and, if the used cans are to be crushed, and reduced in size for shipping, or storage, the plastic, or glass products would cause a serious safety problem, as well as creating a mix of plastic, glass, and aluminum, which would normally cause the crushing machinery to become non-functional, until the plastic, or glass was separated out of the aluminum.

Several approaches have been provided for crushing these cans, and all of them suffer from the problem of distinguishing between the aluminum cans, and the plastic, or glass bottles, used for the same purpose. Normally, the plastic, or glass products are separated from the aluminum by hand, causing a major problem to the crushing apparatus when one of the plastic, or glass bottles, is not separated, and becomes crushed with the aluminum. Many hours are required to separate the pieces of glass from the aluminum, and, in some cases, the machine becomes inoperable, until a repair man is summoned.

SUMMARY OF THE INVENTION

Accordingly, it is an object of this invention to provide an apparatus and method of crushing these cans, and also to distinguish between the plastic, glass, and the aluminum, before the crushing apparatus is operated.

Another object of this invention is to provide this apparatus with automatic operation, having the can itself cause the apparatus to crush the can.

Another object of this invention is to provide this apparatus with enough storage space to store several cases of the cans, before having to empty the apparatus.

Still another object of this invention is to provide this apparatus with sufficient safety features to allow its operation without the possibility of a person being injured, while the crushing is in operation.

In carrying out this invention in the illustrative embodiment thereof, a cabinet, having an opening in its top surface to accept a soft drink can is provided. The can enters a chute at a downward angle, and slides down the chute and is ready for crushing. A spring loaded cover at the opening of this chute closes when the can has been inserted, thereby creating a safe environment for the operator.

Now, this can crusher operates on an automatic cycle, and stops at the end of the cycle. It is a point of interest that this cycle ends with a can in the crushing chamber, ready to be crushed, rather than the crushing chamber being cleared. This feature is used to distinguish between metal, and glass, or plastic, allowing the glass, or plastic bottle to be removed from the chamber, before crushing, should one be inadvertently inserted into the crusher. The bottle can be easily retrieved from the crusher by removing it from the chute.

To start the cycle, a can is inserted into the chute, and slides downward, through an open hinge type stop until it abuts against the end of the chute, Now, a proximity switch, located at the downward end of the chute, senses the presence of the can to be crushed, but, is not activated by glass, or plastic. The closing of this proximity switch provides electric current to a motor, and hydraulic pump. The hydraulic pump provides hydraulic fluid under pressure to a crushing cylinder, and, as there was already a can in the crushing chamber, it is crushed, as the hydraulic piston moves to its extended position, trapping the can between the end of the piston, and the rear of the crushing chamber.

As the piston reaches the end of its travel, the hydraulic pressure builds up, and actuates a hydraulic pressure switch, which supplies power to the hydraulic valve, and, as this is a spring loaded valve, normally in the extend position, when the power is supplied, it is actuated to the retracted position for the hydraulic piston, thereby retracting the piston.

Now, as the piston retracts, it actuates a rod arrangement, at about 5 inches from the forward point of travel for the piston, and pushes this rod rearward. As the rod is connected to a gas loaded cylinder, the cylinder is retracted, causing a pressure to build up in the gas cylinder. Also, this cylinder is connected to a flexible rod, which in turn is connected to, and operates, a gallows type plunger, at the forward end of the loading chute, and the plunger forces the next can downward, through a pair of spring loaded swinging doors, and on into the crushing chamber. Now, as the crushing cylinder reaches the retracted position, a switch is activated, which reverses the direction of the hydraulic fluid to the crushing cylinder, causing this crushing cylinder to move forward to the end of the cycle, which is approximately 4 inches from the end of the extended travel of the piston, and just short of crushing the can which was forced into the crushing chamber.

Now, the forward movement of the crushing piston releases the action of the gas filled cylinder, allowing it to move in an extended position, and, as the cylinder rod is connected to the flexible cable, the gallows arrangement is pushed upward to its starting position, and this upward movement releases the hinge arrangement in the loading chute, allowing the next can to move forward to the proximity switch, triggering a new cycle of the machine. However, when the gallows arrangement reaches its full upward position, it triggers a micro switch, which shuts of the entire machine cycle, and the crusher is in a position to await a new can to be crushed, the present can being in the crusher chamber, but, the crushing piston being stopped just short of the can.

Connected to the crushing piston is a second flexible rod, which activates an ejection piston, which ejects the crushed can from the crushing chamber, as the crushing piston moves rearward to its retracted position. And, the hinge arrangement in the loading chute is now blocked by the forward movement of the crushing piston, and the gallows arrangement, thereby preventing a new can from entering the loading position until the previous cycle is completed. The entering of a new can in the loading chute triggers a new cycle.

Conveniently, the user may insert a can in the loading chute, and the crusher will crush the can, and store it in the bottom of the crusher. When the storage compartment is full, it is emptied, and the crushed cans are recycled.

BRIEF DESCRIPTION OF THE DRAWINGS

This invention, together with other objects, features, aspects and advantages thereof, will be more clearly understood from the following description, considered in conjunction with the accompanying drawings.

DESCRIPTION OF THE PREFERRED EMBODIMENTS

Figure 1:
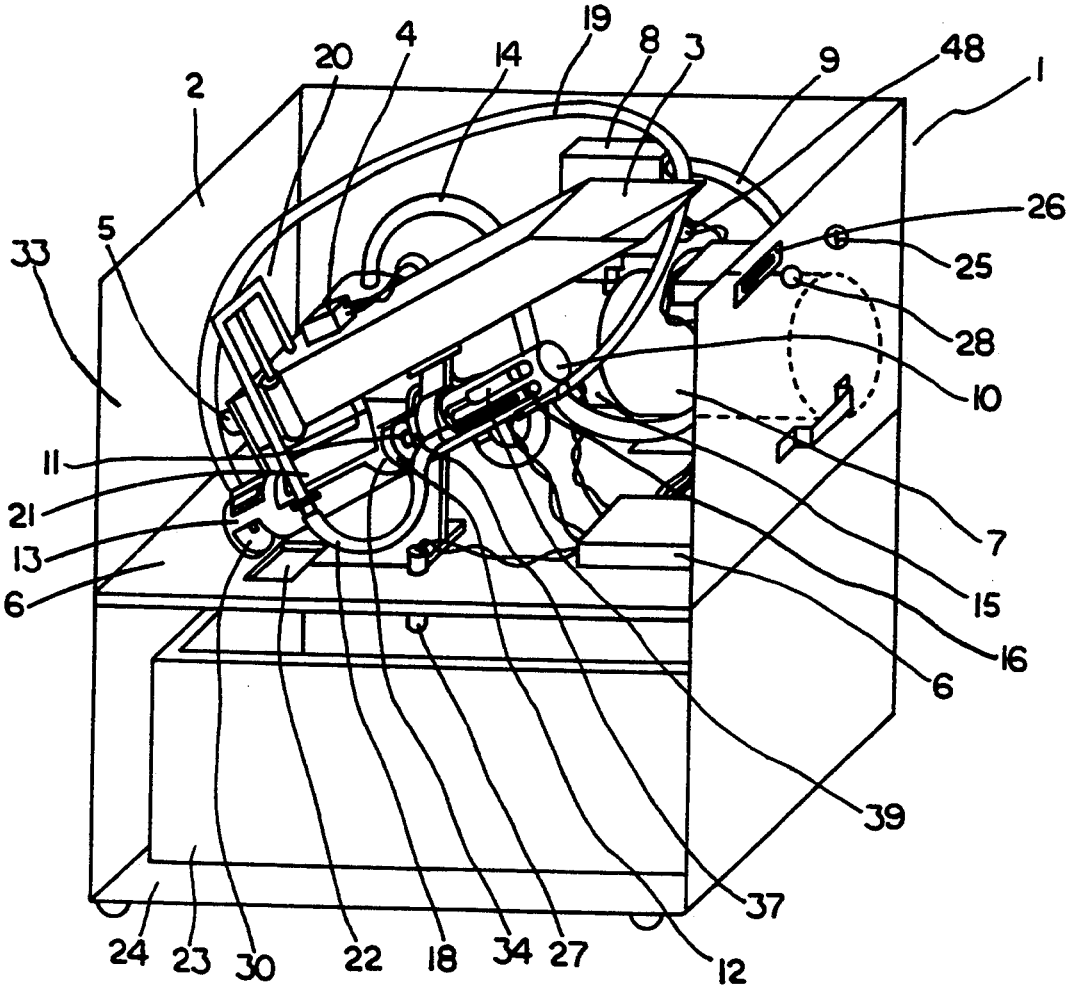
FIG. 1 is an isometric cut-away drawing of the crusher showing the crushing equipment in the top portion, and the storage container in the bottom portion.

Referring now to FIG. 1, a can crusher, referred to generally by the reference numeral 1 is made of a suitable material, and comprises two distinct portions, a top portion 2, and a bottom portion 24. A removeable storage container 23 occupies the area of the lower portion 24, and receives the crushed cans from the crusher 1 for storage.

A power switch 25 controls the input of power to the can crusher, and a resettable counter 26 counts the number of cans crushed. An overfill switch 27, lights an overfill lamp 28, and alerts the operator that the crushed can container 23 is filled, and must be emptied before continuing.

Crushing mechanism 33, for crushing the cans, occupies the top portion 2, and mounts on a flooring 36, of top portion 2. Now, a can is inserted into a loading chute 3, and the can slides downward into chute 3 to the end, where it triggers a proximity switch 5, which switch 5 distinguishes between plastic, glass, and metal, the can being held in a holding compartment over a pair of spring loaded swinging doors 21, held by non-metallic hinges 29, Operation of proximity switch 5 provides current to, a hydraulic pump motor 7, which provides hydraulic pressure to crushing cylinder 10, through hydraulic hose 9, and hydraulic valve 8, and, as hydraulic valve 8 is in its normal "extend" mode, directing hydraulic fluid to enter input port 32, causing piston 11 to move forward, allowing crushing head 12 to crush a can against extrusion bulkhead 13. This forward movement of hydraulic piston 11 continues, until hydraulic pressure builds up to a pressure to override a pressure switch 40, and operation of pressure switch 40 supplying power to hydraulic valve 8, and overriding its spring loaded piston to switch it to its "retract" position, allowing hydraulic fluid to enter return port 31, through hose 14, thereby retracting piston 11 to its "retract" position. Hydraulic reservoir 15 supplies new fluid to system as required.

Figure 2:
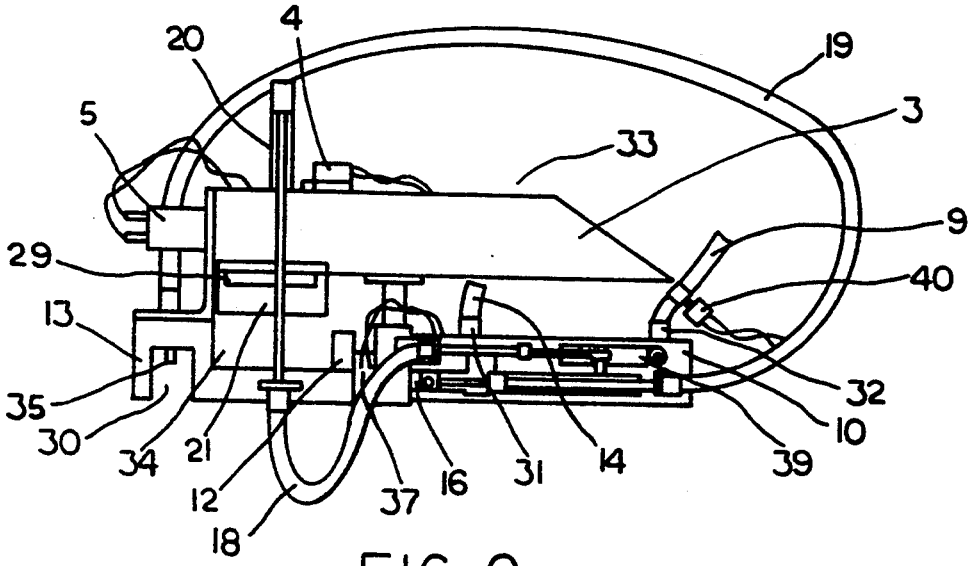
FIG. 2 is a plan view of the loading chute, and the hydraulic cylinder, pump, and connecting flexible rods.
Figure 3:
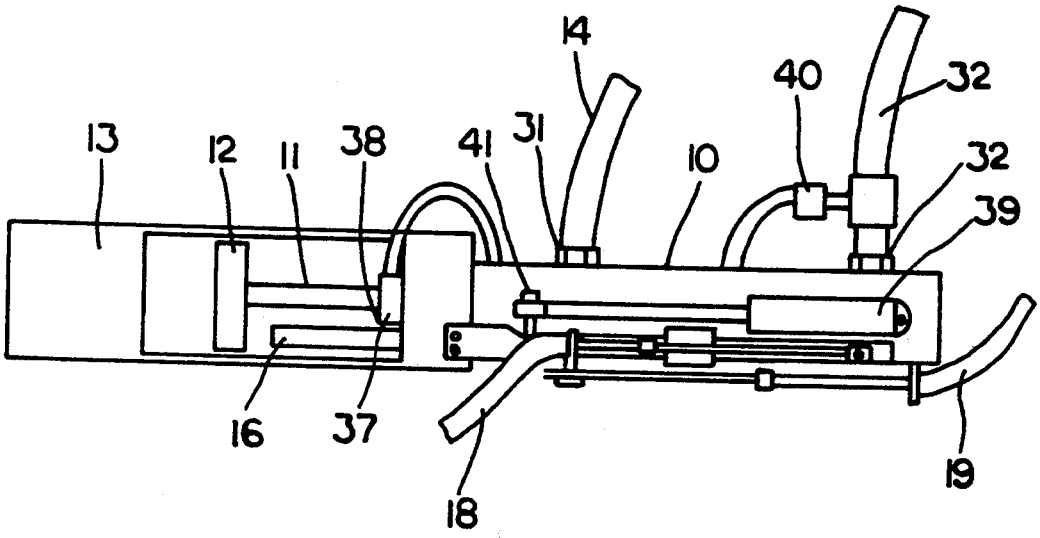
FIG. 3 is a side view of the hydraulic cylinder with the crusher attached to the end of the piston.

Now, and referring to FIG. 3, we see a second cylinder 39 and this cylinder being gas filled, and in its extended position, this position being controlled by travel limit switch 37, and having flexible can expelling rod 19 affixed to its one end, and flexible "new can" pushing rod 18 affixed to a gallows type can pushing apparatus attached to its other end, by attaching pin 41, in a type of push-pull effect. As crushing head 12 retracts, it engages with shaft 16, of cylinder 39, thereby causing cylinder 39 to be retracted, and thereby compressing the gas in cylinder 39, and setting up a pressure spring effect in cylinder 39. Also, the retracting of shaft 16 causes flexible rod 19 to push crushed can through opening 22 of crushing chamber 30, by rod end 35, in those cases where the crushed can does not fall into crushed can container 23 by force of gravity. This action of rod 19 can be seen more clearly in FIG. 2.

Figure 4:
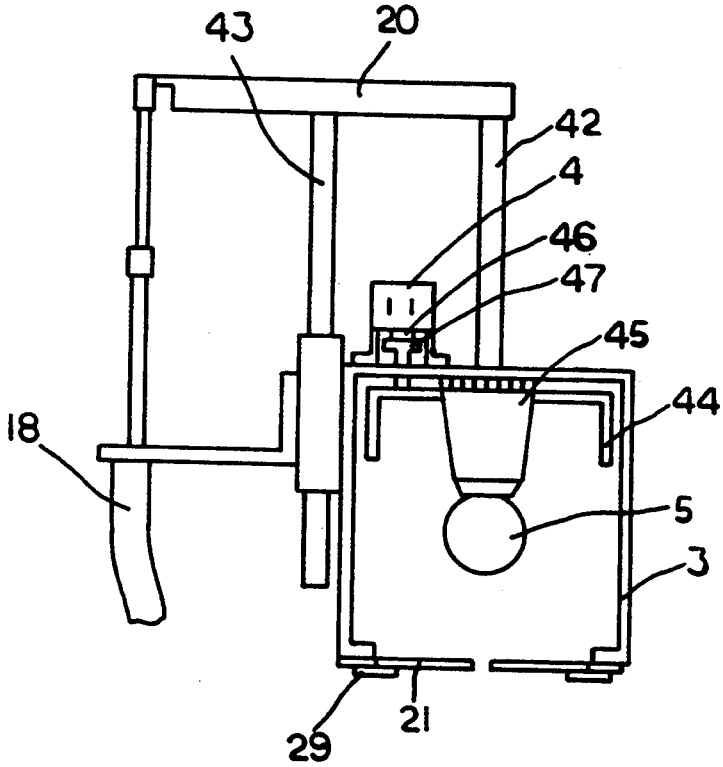
FIG. 4 is an end view of the loading chute, showing the gallows type of pusher, and the swinging doors which hold the next can to be crushed.

Also, at the same time, on a timed basis, flexible rod 18 is pulled into its retracted position, and, as rod 18 is connected to a gallows type apparatus 20, gallows type apparatus 20 is pulled downward, guided by guide rod 43, pushing a new can into crushing chamber 34, using push plate 44, new cans being blocked from entering the crusher by blocking gate 45, blocking gate 45 being released to accept new cans, when pushing plate 44 is in its upward, retracted position. As seen more clearly in FIG. 4, actuating push rod 42 moves downward, pushing a new can through swinging doors 21, and into crushing chamber 34. During this period of the cycle, new cans are blocked from entering the crusher by the blocking of gate 45 by push plate 44 in its downward, extended position. In its upper, retracted position push plate 44 releases blocking plate 45 to operate freely, thereby allowing a new can to enter the crusher 1.

This retracting of piston 11 continues until piston 11 is in a fully retracting position, activating a limit switch 38, which supplies power to hydraulic valve 8, causing a reversal in the flow of hydraulic fluid to hydraulic cylinder 10, through input 32, and hydraulic hose 9, forcing piston 11 in forward, extended direction. Piston 11 moves forward, and, as shaft 16 of gas filled cylinder 39 is directly connected to piston 11, it is allowed to travel also to its extended position, and, as flexible rod 18 is extended, and flexible rod 18 being connected to the gallows type push pull assembly 20, assembly 20 is moved upward until plunger 47 actuates power cutoff switch 4, by actuator 46, stopping power to hydraulic motor pump 7, and stopping the travel of piston 11 a point just short of crushing the can in crushing chamber 34, and, the entire crushing cycle is completed.

Accordingly, a very unique, attractive, convenient method and apparatus are provided for crushing cans, storing the crushed cans for future recycling, and for distinguishing between the plastic, or glass bottles, and the metal cans, before they are crushed.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A can crusher, comprising:

a substantially rectangular cabinet, having at least two hinged access panels, and at least two separate, but attached portions, said two portions being:

(b) a top portion, and, (c) a bottom portion, said bottom portion including a removeable crushed can storage container, and said bottom portion having gravity fed crushed can accepting means to said container, said accepting means being an opening in the top surface of said bottom portion, said top portion providing mounting and enclosing means for said can crusher, comprising:

(d) a substantially rectangular can insertion chute, of a size to accept cans, said chute attached to the top surface of said top portion at the upper end of the chute, and being mounted at a downward angle from said top surface, said chute having can entrance means to a crushing chamber at the bottom lower end of the chute, and said chute having spring loaded cover means at the extreme upper end of the chute, (e) a push-pull type hydraulic cylinder and piston, having crushing means for said cans, said cylinder fitting into, and operating within said can crushing chamber, said can crushing chamber being of a size to accept a can, and having an open top, surrounding cylindrical sides, one open top end, and a closed bottom end, two spring loaded trap doors for the bottom of the chamber, said chamber being affixed directly below said chute, and said chamber being attached to said top portion of said can crusher, mating with the bottom of said chute, said chamber enclosing:

(f) said crushing cylinder and piston providing crushing means for cans within said crushing chamber, (g) a separate gas filled cylinder and piston, said gas filled cylinder being inversely connected to said crushing cylinder, thereby acting to extend the piston of said gas filled cylinder when said piston of said crushing cylinder is retracted, and, with the associated inverse reaction, thereby acting to retract said piston of said gas filled cylinder when said piston of said crushing cylinder is extended, thereby providing can ejection means for said crushed cans from said can crushing chamber to said can storage container, said ejection means being:

(h) a flexible rod attached to said piston of said gas filled cylinder at one end of the flexible rod, and said flexible rod being connected at its other end to a push pull gallows apparatus, said flexible rod being extended, or retracted by the action of the piston of said gas filled cylinder, and said push pull gallows apparatus forcing said crushed can from said crushing chamber through said spring loaded trap doors in the bottom of said crushing chamber, and down into said storage container, during the retracting cycle of said crushing cylinder, said push pull gallows apparatus also de-activating a cycle control switch at the end of its travel during the extension cycle of said crushing cylinder, thereby providing turn off means for said can crusher, (j) a motor, said motor driving a hydraulic pump, said pump providing hydraulic pressure for said hydraulic crushing cylinder.

2. A can crusher of claim 1 having metal-plastic discriminating means, said discriminating means being a metal proximity switch, said discriminating switch also having turn on means for a cycle of said can crusher.

3. A can crusher of claim 2, having an electrical controlled, spring loaded, return to normal switch, said switch providing hydraulic fluid directing means for said push-pull operation of said hydraulic cylinder.

* * * * *